US012018462B2

(12) United States Patent
Jagoda

(10) Patent No.: US 12,018,462 B2
(45) Date of Patent: Jun. 25, 2024

(54) CONTROLLER AND CONTROL SYSTEM WITH ENHANCED ORIENTATION DETECTION FOR MOBILE HYDRAULIC EQUIPMENT

(71) Applicant: DANFOSS POWER SOLUTIONS II TECHNOLOGY A/S, Nordborg (DK)

(72) Inventor: Aaron H. Jagoda, Bloomington, MN (US)

(73) Assignee: DANFOSS A/S, Nordborg (DK)

( * ) Notice: Subject to any disclaimer, the term of this patent is extended or adjusted under 35 U.S.C. 154(b) by 768 days.

(21) Appl. No.: 17/256,818

(22) PCT Filed: Jun. 29, 2019

(86) PCT No.: PCT/US2019/040019
§ 371 (c)(1),
(2) Date: Dec. 29, 2020

(87) PCT Pub. No.: WO2020/006537
PCT Pub. Date: Jan. 2, 2020

(65) Prior Publication Data

US 2021/0285187 A1 Sep. 16, 2021

Related U.S. Application Data

(60) Provisional application No. 62/691,975, filed on Jun. 29, 2018.

(51) Int. Cl.
*E02F 9/26* (2006.01)
*E02F 9/20* (2006.01)

(52) U.S. Cl.
CPC ..... *E02F 9/264* (2013.01); *E02F 9/2041* (2013.01); *E02F 9/265* (2013.01)

(58) Field of Classification Search
CPC ..... E02F 9/264; E02F 9/265; E02F 9/2033; E02F 9/2037; E02F 9/2041; E02F 9/2045;
(Continued)

(56) References Cited

U.S. PATENT DOCUMENTS 5,048,296 A 9/1991 Sunamura et al.
5,832,730 A 11/1998 Mizui
(Continued)

FOREIGN PATENT DOCUMENTS

EP 2 511 678 A1 10/2012
EP 2511678 A1 * 10/2012 ..... E02F 9/24
(Continued)

OTHER PUBLICATIONS

International Search Report and Written Opinion of the International Searching Authority for International Patent Application No. PCT/US2019/040019 dated Oct. 17, 2019, 11 pages.

*Primary Examiner* — Spencer D Patton
(74) *Attorney, Agent, or Firm* — Merchant & Gould P.C.

(57) ABSTRACT

A hydraulic machine can include one or movable loads and one or more control units associated with actuators operating the movable loads. The control units can include an accelerometer, a gyroscope, and a magnetometer, the accelerometer being adapted to detect an orientation of the control unit relative to a gravity force vector, the magnetometer being adapted to detect an orientation of the control unit relative to a fixed magnetic field, and the gyroscope being adapted to detect yaw, pitch and roll, rates of the control unit. The magnetometer can be used to align the data from the control units such that the position, orientation, and velocity of the movable loads, including an end effector of the hydraulic machine, can be determined and controlled.

17 Claims, 5 Drawing Sheets

(58) Field of Classification Search
CPC . E02F 3/434; E02F 3/437; E02F 3/438; E02F 3/439
See application file for complete search history.

(56) References Cited

U.S. PATENT DOCUMENTS

| | | | | |
|---|---|---|---|---|
| 6,202,013 | B1 | 3/2001 | Anderson et al. | |
| 6,883,532 | B2 | 4/2005 | Rau | |
| 7,143,682 | B2 | 12/2006 | Nissing et al. | |
| 9,810,242 | B2 | 11/2017 | Wang | |
| 10,036,407 | B2 | 7/2018 | Rannow et al. | |
| 10,316,929 | B2 | 6/2019 | Wang et al. | |
| 10,323,663 | B2 | 6/2019 | Wang et al. | |
| 10,344,783 | B2 | 7/2019 | Wang et al. | |
| 2011/0150615 | A1* | 6/2011 | Ishii | E02F 3/965 701/50 |
| 2012/0308354 | A1* | 12/2012 | Tafazoli Bilandi | E02F 9/264 414/815 |
| 2016/0076228 | A1 | 3/2016 | Nau | |
| 2018/0372498 | A1* | 12/2018 | Nackers | E02F 3/434 |
| 2020/0124060 | A1 | 4/2020 | Yuan | |
| 2020/0124061 | A1 | 4/2020 | Yuan et al. | |
| 2020/0124062 | A1 | 4/2020 | Yuan | |

FOREIGN PATENT DOCUMENTS

| | | | |
|---|---|---|---|
| EP | 2 910 912 | A1 | 8/2015 |
| WO | 2014/193649 | A1 | 12/2014 |
| WO | 2015/031821 | A1 | 3/2015 |
| WO | 2015/073329 | A1 | 5/2015 |
| WO | 2015/073330 | A1 | 5/2015 |
| WO | 2016/011193 | A1 | 1/2016 |
| WO | 2018/200689 | A1 | 11/2018 |
| WO | 2018/200696 | A1 | 11/2018 |
| WO | 2018/200700 | A1 | 11/2018 |
| WO | 2020/006538 | A1 | 1/2020 |

* cited by examiner

CONTROLLER AND CONTROL SYSTEM WITH ENHANCED ORIENTATION DETECTION FOR MOBILE HYDRAULIC EQUIPMENT

This application is a National Stage Application of PCT/US2019/040019, filed on Jun. 29, 2019, which claims the benefit of U.S. Patent Application Ser. No. 62/691,975, filed on Jun. 29, 2018, the disclosures of which are incorporated herein by reference in their entireties. To the extent appropriate, a claim of priority is made to each of the above disclosed applications.

BACKGROUND

Hydraulic equipment relies on hydraulic actuators, typically hydraulic actuators, to drive loads. In certain applications, and particularly mobile equipment applications, the absolute and relative orientations of each load dictate how the hydraulics associated with each actuator should be controlled for a given set of static or dynamic conditions. In controlling actuator hydraulics, it is desirable to minimize wasted energy and maximize the equipment's overall stability and smooth operability.

SUMMARY

In general terms, the present disclosure is directed to a device with improved mobile orientation sensing, and mobile hydraulic systems incorporating one or more such devices. Such mobile hydraulic systems include, for example, a hydraulic machine such as a mobile crane, a backhoe or other loader, an excavator, a tractor, a telehandler, etc. Each device is adapted to provide signals. In some examples, the device is a controller and the signals are control signals that are fed to one or more solenoids. The solenoids drive valves (e.g., spool valves) to provide metered flow (depending on the control signal) into and out of the actuator to drive the load as desired. In some examples, the signals are equipment status signals. The equipment status signals can be provided to an alert system to alert an operator as to a potential consequence of performing or not performing a certain operation with the equipment.

Equipment and load positioning and orientation are important in many mobile hydraulic equipment applications. When driving a load, for example, the position and motion of the load relative to the force of gravity, relative to the surface of the ground, relative to the equipment's other loads, relative to the equipment's support structure (e.g., the chassis), etc. can all be relevant pieces of data. Likewise, the position or attitude of the equipment's support structure (e.g., the chassis) relative to the force of gravity and/or relative to the surface of the ground is important to ensure the equipment's stability.

In some examples, a device according to the present disclosure includes a sensor unit having at least two of an accelerometer, a magnetometer, and a gyroscope. In some examples, a device according to the present disclosure includes a sensor unit having all three of an accelerometer, a magnetometer, and a gyroscope. The accelerometer is adapted to measure acceleration due to gravity or a hydraulic force. The magnetometer is adapted to measure a magnetic field strength, such as Earth's characteristic magnetic field. The gyroscope is adapted to measure yaw, pitch, and roll rates. The measurements from the at least two or all three of the accelerometer, magnetometer, and gyroscope are combined to provide enhanced orientation and position information of the device. In addition, or alternatively, different sensors from among the accelerometer, magnetometer, and gyroscope are utilized depending on the mode of the hydraulic equipment, e.g., depending on whether the hydraulic equipment is in initialization or other non-operating mode (power off), in start-up mode, or an operating mode. If the device is associated with a particular component of the equipment, e.g., the chassis, or a particular hydraulic actuator (e.g., the actuator associated with the equipment's boom, arm, or bucket), the sensory inputs collected by the sensor unit are associated with that particular component of the equipment. In that case, systems, such as hydraulic equipment with independently mobile components that each include one of the devices, can share the data (via electronic interconnections between the devices) collected from the different input devices to provide system-wide orientation and position information, which can be used, in conjunction with component-specific orientation and position information, to generate the needed hydraulic control signals or other signals, such as alert signals.

In one example, a hydraulic system includes one or movable loads and one or more control units, each of the one or more control units being associated with one of the one or more movable loads, the control unit including an accelerometer, a gyroscope, and a magnetometer, the accelerometer being adapted to detect an orientation of the control unit relative to a gravity force vector, the magnetometer being adapted to detect an orientation of the control unit relative to a fixed magnetic field, and the gyroscope being adapted to detect yaw, pitch and roll, rates of the control unit.

In some examples, the hydraulic system includes a plurality of independently movable loads and a plurality of the control units, each of the plurality of control units being associated with one of the independently movable loads.

In some examples, each control unit is adapted to process data collected by the accelerometer and the magnetometer when the hydraulic system is a non-operational mode, and wherein each control unit is adapted to process data collected by the gyroscope when the control hydraulic system is in an operational mode.

In some examples, the processing of the data collected from the accelerometer and the magnetometer includes determining orientation and heading of the associated control unit to provide initial positions of one or more components of the hydraulic system.

In some examples, the processing the data collected from the gyroscope is combined with the initial positions to determine current positions of the one more components of the hydraulic system.

In some examples, the processing the data includes applying the data to a kinematic model.

In some examples, each control unit does not process data collected by the gyroscope when the hydraulic system is in a non-operational mode.

In some examples, each control unit does not process data collected by the accelerometer or by the magnetometer when the hydraulic system is an operational mode.

In some examples, the hydraulic system comprises one of: a crane, an excavator, and a loader.

In some examples, the hydraulic system includes a chassis adapted to be positioned on the ground, the chassis having associated therewith one of the one or more control units.

In some examples, at least one of the one or more control units is installed on a hydraulic actuator.

In some examples, a first of the or more control units is installed on a hydraulic actuator associated with a boom, a second of the one or more control units is installed on a hydraulic actuator associated with an arm, and a third of the one or more control units is installed on a hydraulic actuator associated with a bucket, wherein the first, second and third units are adapted, respectively, to determine, using data collected from the accelerometer, magnetometer, and gyroscope, positions of the boom, the arm and the bucket.

In some examples, each of the one or more control units is adapted to use data collected from one or more of the accelerometer, the gyroscope, and the magnetometer to perform one or more of: control placement of one or more stabilizers; achieve level positioning of at least one component of the system relative to the ground; detect a deviation from a level condition; provide an alert to an operator; control position, velocity, and/or acceleration of a rotating or non-rotating structure; return a component from a current position to preset position; constrain movement of a component in space; prevent tipping of a chassis; maximize a bucket capacity; and maximize stability of the system.

A method for operating a work machine includes receiving data from a plurality of sensors associated with a hydraulic machine, wherein one or more of the plurality of sensors includes an accelerometer and a gyroscope, processing the data to determine one or more of a velocity, an orientation, and a location of a component of the hydraulic machine, and providing an output to one or more actuators associated with one or more components of the work machine based on the processed data.

In some examples, the one or more of the plurality of sensors further includes a magnetometer.

In some examples, the method includes determining an orientation of each of the plurality of sensors with respect to each other and the work machine with data received from the magnetometers.

In some examples, the step of processing the data includes utilizing a rotation matrix.

In some examples, the plurality of sensors includes a sensor associated with a platform rotatable with respect to a chassis of the work machine, a sensor associated with a boom of the work machine, a sensor associated with an arm of the work machine, and a sensor associated with an end effector of the work machine.

In some examples, the step of processing the data includes calculating a position of the end effector.

In some examples, the one or more actuators includes an actuator associated with the platform to rotate the platform with respect to the chassis; an actuator associated with the boom to move the boom relative to the platform; an actuator associated with the arm to move the arm relative to the boom; and an actuator associated with the end effector to move the end effector relative to the arm.

DETAILED DESCRIPTION

Various embodiments will be described in detail with reference to the figure. Reference to various embodiments does not limit the scope of the claims attached hereto. Additionally, any examples set forth in this specification are not intended to be limiting and merely set forth some of the many possible embodiments for the appended claims.

Figure 1:
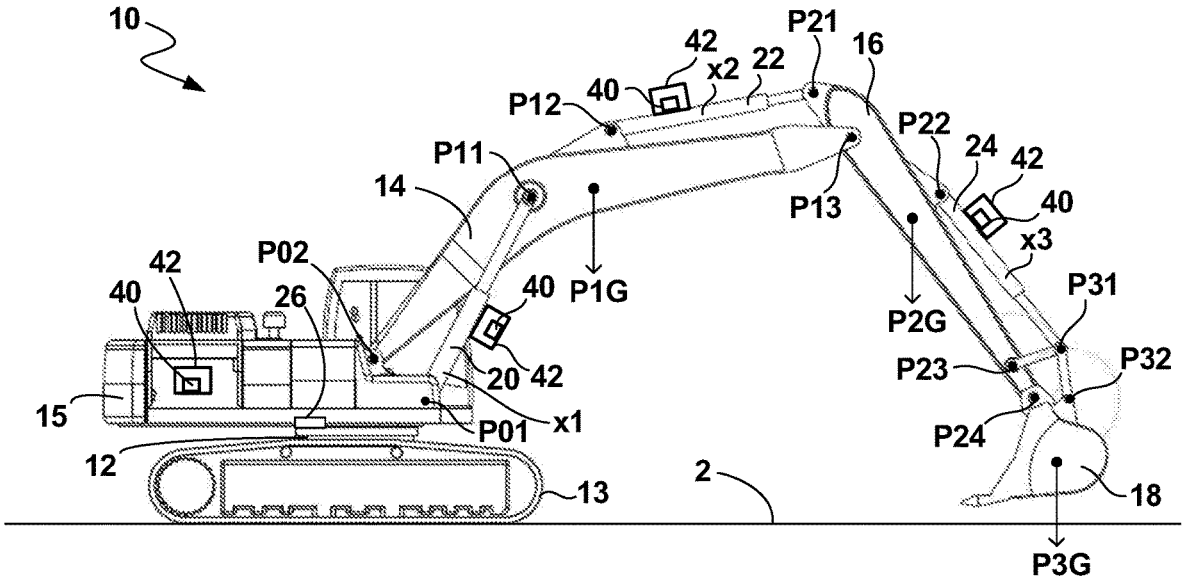
FIG. 1 is a schematic illustration a first example of a hydraulic machine according to the present disclosure.

Referring to FIG. 1, a hydraulic machine 10 is shown. In this example, the equipment 10 is an excavator. The excavator 10 includes a chassis 12 supported by wheels, tracks or other stabilizers 13 resting on a surface 2 (e.g., the ground), the wheels or tracks 13 adapted to propel the chassis along the ground 2. In the example shown in FIG. 1, the hydraulic equipment 10 is an excavator 10 with tracks 13. In the example shown at FIG. 1A, the hydraulic equipment 10 is a mobile crane or excavator truck 10 with wheels 13, wherein one or more stabilizers 30 are provided to stabilize the chassis relative to the surface 2. The following description is equally applicable to the examples shown at FIGS. 1 and 1A.

The excavator 10 includes a boom 14 and its associated hydraulic actuator 20; an arm 16 and its associated hydraulic actuator 22, and a bucket 18 and its associated hydraulic actuator 24. A hydraulic actuator 26 can also be provided to rotate the platform or upper structure 15 supporting the excavator assembly 14, 16, 18 with respect to the chassis 12. In the example shown, the actuators 20, 22, 24 are linear acting hydraulic actuators while actuator 26 is a hydraulic motor. Other configurations are possible.

Hydraulic System

Figure 2:
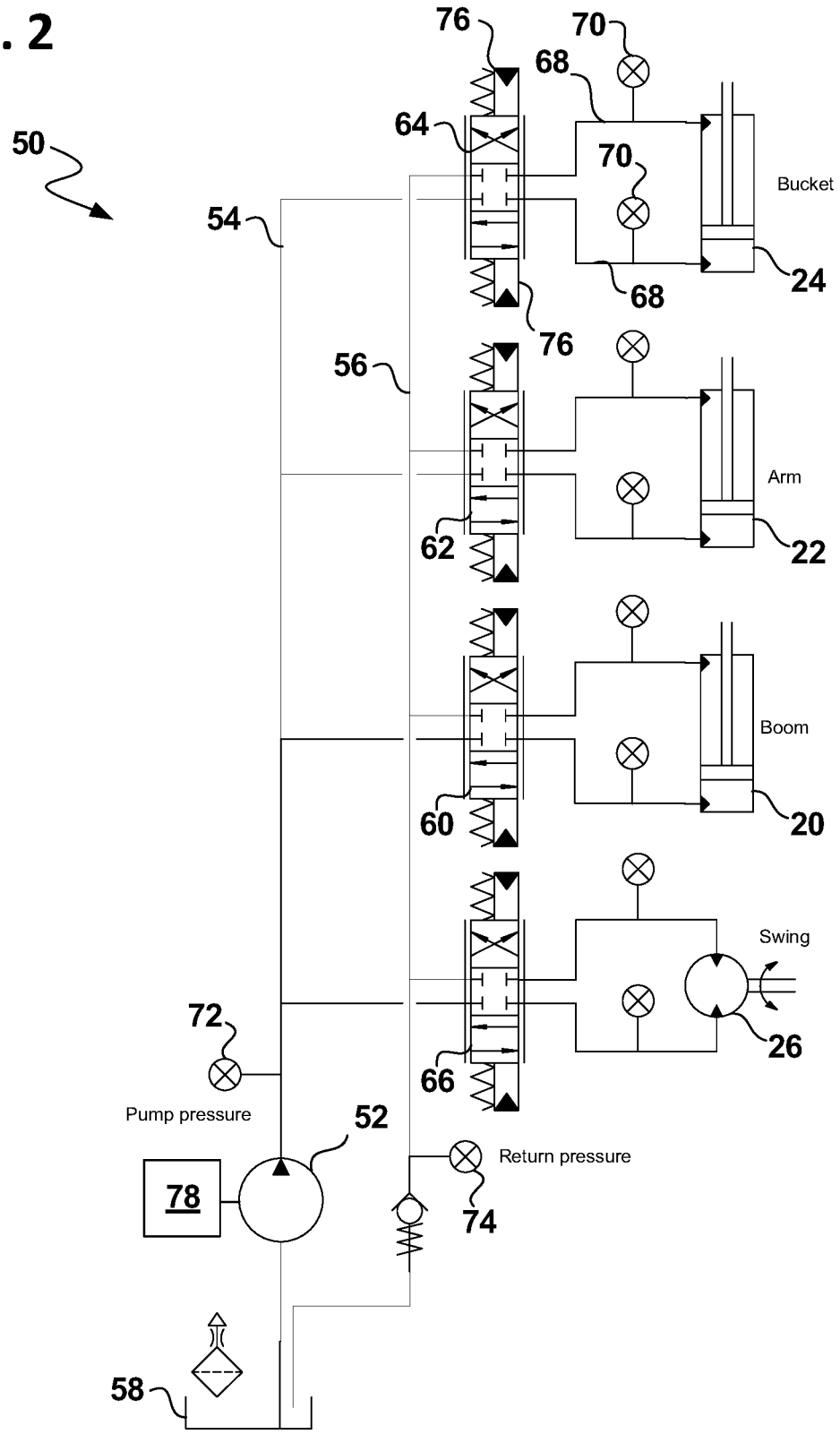
FIG. 2 is a hydraulic schematic associated with the hydraulic machine shown in FIGS. 1 and 1A.

As shown schematically at FIG. 2, the hydraulic machine 10 includes a hydraulic system 50 that includes the actuators 20, 22, 24, 26. In one aspect, the hydraulic system 50 includes a pump 52, supply lines 54, return lines 56, and a reservoir 58. The hydraulic system 50 is further shown as including control valves 60, 62, 64, 66, in fluid communication with the supply and return lines 54, 56, that are selectively controlled to operate the actuators 20, 22, 24, 26 via branch lines 68 that provide metered flow through input and output ports of each actuator. The hydraulic system 50 can also include a variety of other components, for example, branch line pressure sensors 70, supply and return line pressure sensors 72, 74, and valve actuators 76. In the example shown, each of the control valves is a four-way, three-position valve. Other configurations are possible, such as using independent metering valves.

Control System

Figure 3:
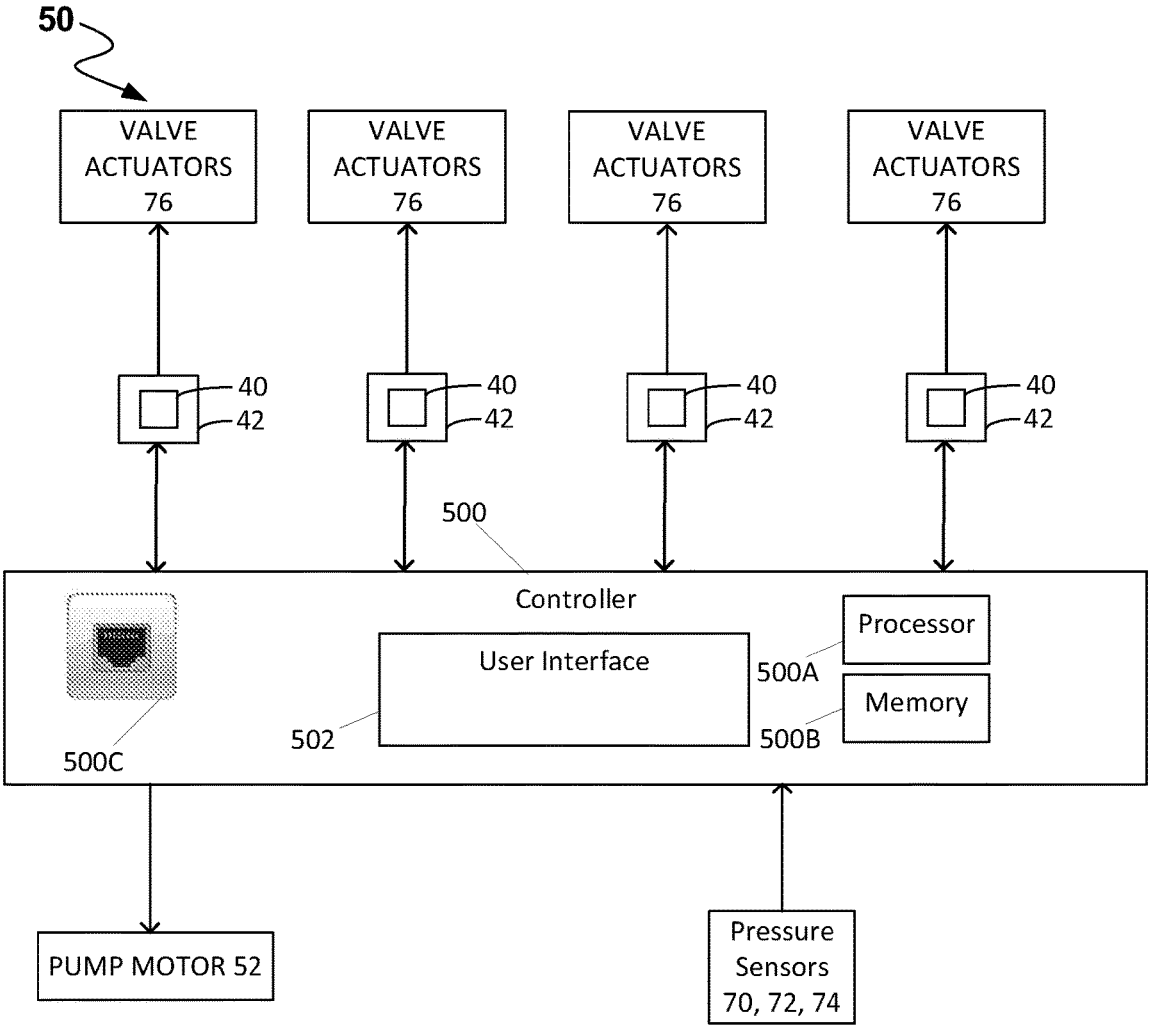
FIG. 3 is a schematic of a control system usable with the hydraulic machine shown in FIGS. 1 and 1A.

Referring to FIG. 3, the machine 10 may also include an electronic controller 500. The electronic controller 500 is schematically shown as including a processor 500A and a non-transient storage medium or memory 500B, such as RAM, flash drive or a hard drive. Memory 500B is for storing executable code, the operating parameters, and the input from the operator user interface 502 while processor 500A is for executing the code. The electronic controller is also shown as including a transmitting/receiving port 500C, such as a CAN bus connection or an Ethernet port for two-way communication with a WAN/LAN related to an automation system. A user interface 502 may be provided to activate and deactivate the system, allow a user to manipulate certain settings or inputs to the controller 500, and to view information about the system operation.

The electronic controller 500 typically includes at least some form of memory 500B. Examples of memory 500B include computer readable media. Computer readable media includes any available media that can be accessed by the processor 500A. By way of example, computer readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the processor 500A.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

The electronic controller 500 is also shown as having a number of inputs/outputs that may be used for implementing the below described operational capabilities of the machine 10. Referring to FIGS. 1 and 3, each of the actuators 20, 22, and 24 and the chassis 12 includes an associated sensor unit 40. One or more of the sensor units 40 can be operably coupled to a control unit 42 that provides control signals to drive the associated actuator or to drive a hydraulic component of the chassis 12. In some examples, each of the sensor units 40 includes a magnetometer, an accelerometer, and a gyroscope. In some examples, the sensor units 40 are configured as "nine degree-of-freedom" (9 DOF) sensors with the ability to collect data from the magnetometer, accelerometer, and gyroscope along three axes (e.g. x, y, and z axes). The controller 500 can also include additional inputs and outputs for desirable operation of the machine 10 and related systems. For example, the controller can include outputs for an actuator 78 (e.g. an electric motor) for the pump 52 and for the actuators 76 for the control valves 60, 62, 64, 66 and can include inputs for the pressure sensors 70, 72, 74. In some examples, the control unit 42 provides a direct output to the valve actuators 76 of the control valve 60-64 associated with the actuator 20-26 to which the control unit 42 is mounted. Other configurations are possible. For example, the controller 500 provides a direct output to the valve actuators 76.

System and Operation

Figure 1A:
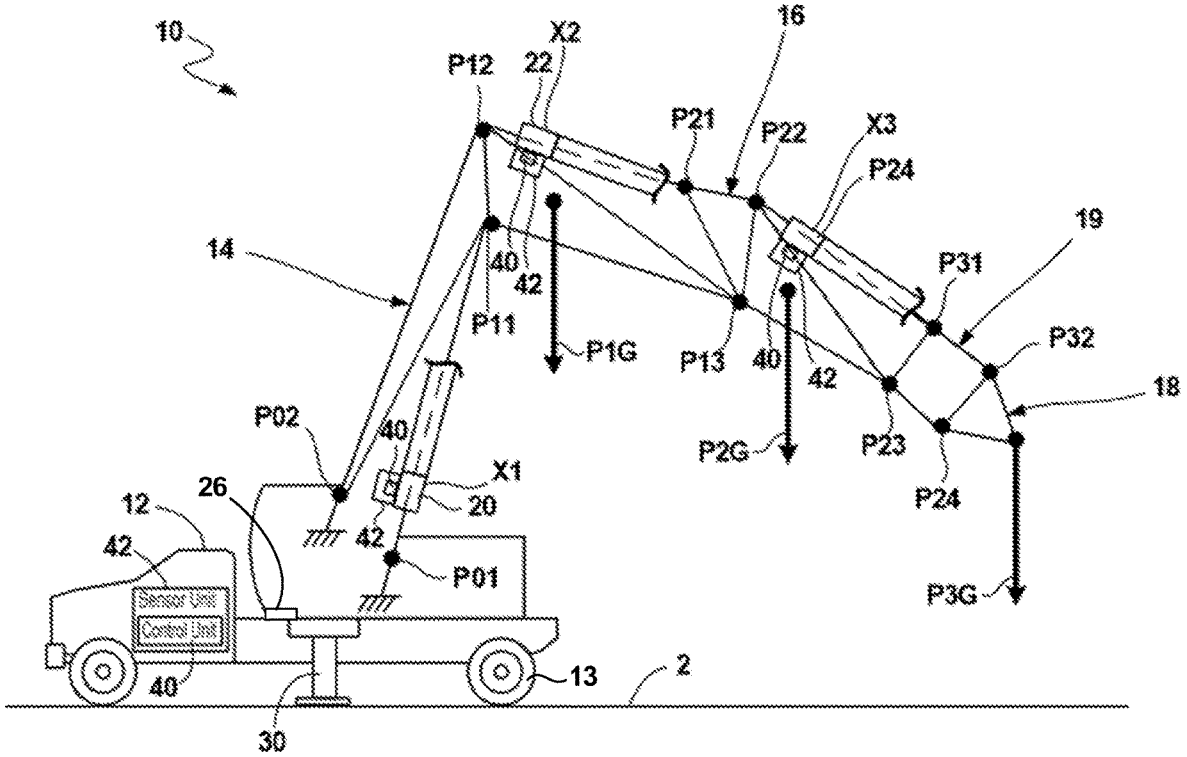
FIG. 1A is a schematic illustration of a second example of a hydraulic machine according to the present disclosure.

Referring to back to FIGS. 1 and 1A, P01 corresponds to the location where the chassis 12 couples to the boom actuator 20. P02 corresponds to the location where the chassis 12 couples to the boom 14. P11 corresponds to the location where the boom actuator 20 couples to the boom 14. P12 corresponds to the location where the boom 14 couples to the arm actuator 22. P13 corresponds to the location where the boom 14 couples to the arm 16. P21 corresponds to the location where the arm 16 couples to the arm actuator 22. P22 corresponds to the location where the arm 16 couples to the bucket actuator 24. P23 corresponds to the location where the arm 16 couples to the bucket support 19. P24 corresponds to the location where the arm 16 couples to the bucket 18. P31 corresponds to the location where the bucket actuator 24 couples to the bucket support 19. P32 corresponds to the location where the bucket support 19 couples to the bucket 18. P1G corresponds to the center of gravity of the boom 14. P2G corresponds to the center of gravity of the arm 16. P3G corresponds to the center of gravity of the bucket 18. x1 corresponds to the hydraulic state of the boom actuator 20; x2 corresponds to the hydraulic state of the arm actuator 22; and x3 corresponds to the hydraulic state of the bucket actuator 24.

Thus, for the hydraulic system corresponding to the excavator 10, the locations of P01 and P02 depend on the orientation of the ground 2; the locations of P11, P12, P13 and P1G depend on the ground 2 and x1; the locations of P21, P22, P23, P24, and P2G depend on the ground, x1 and x2; and the locations of P31, P32 and P3G depend on the ground, x1, x2, and x3. Using real time acceleration, gyroscopic, and/or magnetic inputs from the sensor units 40 on each of the actuator mounted control units 42 and the equipment geometry described in the Figure, a kinematic model of the excavator 10 can be generated and referred to by the control units 42 and/or a central controller or processing unit to determine positioning of the boom 14, the arm 16, and the bucket 18. Where a control unit 42 is mounted to the actuator instead of the movable load associated with the actuator, the model can include standard trigonometric and geometric correlations to calculate the condition (e.g. position, velocity, etc.) of the movable load based on the sensed conditions of the associated actuator. Where a control unit 42 is mounted directly to the movable load, such correlations may be unnecessary.

Using inputs from the sensor units 40, and selectively combining those inputs as appropriate, the orientation of each of the control units 42 is determinable. As such, in general terms, the control system can be operated as process 1000, as shown at FIG. 5, wherein the controller 500 receives position-related data from a plurality of sensors including accelerometers, gyroscopes, and magnetometers associated with the hydraulic machine at a step 1002.

Based on a detected orientation of a control unit 42, a corresponding orientation of the corresponding equipment component can be determined. For example, the attitude of the chassis 12 relative to the ground 2 can be determined based on a detected orientation of the control unit 42 associated with the chassis 12. That control unit can, in turn, output appropriate control signals or other signals to cause an adjustment in the attitude of the chassis 12 or the one or more stabilizers 30, and/or to provide an alert of unsafe or impending unsafe condition relating to the chassis 12.

An example initialization of a system including the equipment 10 and the various control units 42 having sensor units 40 is as follows: with the excavator 10 in a known orientation, i.e., with all of the actuators 20 fully extended, the sensor units 40 are initialized. In particular, before the valves associated with the actuators 20 and corresponding control units 42 are energized, the magnetometer of each of the sensor units 40 is used to locate magnetic north. In addition, before there is any machine motion, the accelerometer of each of the sensor units 40 is used to determine a direction to ground for the corresponding control unit 42. With the initialization data from the magnetometers and accelerometers a rotation matrix is generated for each control unit 42 so that all of the control units 42 use the same coordinate frame as the control unit 42 mounted to the chassis 12. The rotation matrices compensate for variations in installation orientation of the control units 42 to their respective equipment component. In at least some examples, the rotation matrices are stored in a memory of the overall system that includes the equipment 10, the system including one or more processors adapted to execute computer-readable instructions.

In one example initialization process, the hydraulic machine is moved to a convenient known calibration position, the solenoids of the valve actuators are de-energized to minimize interference with magnetometers, the machine is verified as being by using gyroscopes which will read zero when there is no motion, the measurements from the 3-axis accelerometer and 3-axis magnetometer are recorded. The orientation of each individual sensor is then calculated in terms of heading (T) with respect to magnetic north, roll angle (a) and pitch angles with respect to ground ((3) using the convention x forward, z up and y left where:

$$\alpha = \arctan\left(\frac{A_y}{A_z}\right) \qquad \text{Formula 1}$$

$$\beta = \arctan\left(\frac{-A_x}{A_y\sin(\alpha) + A_z\cos(\alpha)}\right)$$

$$\gamma = \arctan\left(\frac{M_z\sin(\alpha) - M_y\cos(\beta)}{M_x(\beta) + M_y\sin(\beta)\sin(\alpha) + M_z\sin(\beta)\cos(\alpha)}\right)$$

In one example, the rotation matrix (Ri) for each sensor (i) is developed according to the following formula:

$$R = \begin{bmatrix} \cos(\gamma) & -\sin(\gamma) & 0 \\ \sin(\gamma) & \cos(\gamma) & 0 \\ 0 & 0 & 1 \end{bmatrix} \begin{bmatrix} \cos(\beta) & 0 & \sin(\beta) \\ 0 & 1 & 0 \\ -\sin(\beta) & 0 & \cos(\beta) \end{bmatrix} \begin{bmatrix} 1 & 0 & 0 \\ 0 & \cos(\alpha) & -\sin(\alpha) \\ 0 & \sin(\alpha) & \cos(\alpha) \end{bmatrix} \qquad \text{Formula 2}$$

The rotation matrix can be applied to all future accelerometer, gyroscope and magnetometer readings so that the readings from the sensors can be easily interpreted from the same reference frame such that the sensors are aligned using the rotation matrices generated for each sensor. For example, the sensors can be aligned such that all motion of the boom, arm and bucket will be in the X-Z plane with all rotation about the y-axis and such that the swing motion of the upper structure or platform will be registered as rotation about the z-axis on all sensors. Once these rotation matrices are created for each sensor in a known machine orientation then the current orientation of any of the sensors and therefor the machine orientation can be determined by integrating the gyro measurements of angular rate to determine the angle which a the machine has moved through and adding this value to the initial position, as described above.

In an example power-up stage or mode of the equipment 10, following initialization of the overall system, the accelerometers and magnetometers of the sensor units 40 can again be used to determine the orientation and heading of each of the control units 42. The collected data from the accelerometers and magnetometers is processed, using the kinematic model shown in the Figure, to determine initial (i.e., at machine start-up) positions of the various equipment components (chassis, boom, arm, bucket).

In an example operating stage or mode of the equipment 10, following startup of the equipment, and during operating of the equipment, the magnetic field produced by the solenoids that drive the hydraulic valves interferes with the magnetometers' readings of magnetic north. However, the gyroscopes of the sensor units 40 detect the yaw, pitch, and roll rates at each of the control units 42 installed at an actuator 20, and these vectors are transformed into the common coordinate frame using the rotation matrices described above. The transformed vectors of yaw, pitch and roll rates are integrated and added to the initial position values to provide an angle of rotation for each of the sensor units 40, and these angle values are then used to determine the position of the boom, bucket and arm using the kinematic model.

Recalibration of the sensor units 40 is also achievable. For example, periodically when the machine is not being accelerated, the accelerometers of the sensor units 40 are used to re-initialize orientation with respect to the ground 2, since the only acceleration that the accelerometers detect under such conditions is acceleration due to gravity.

In one example use of a system according to the present disclosure, a control unit 42 having a sensor unit 40 is installed on the chassis of a mobile crane. The control unit 42 uses orientation data from the sensor unit 40 to, e.g., perform one or more of: determine if the chassis is level; control placement of one or more stabilizers to achieve level positioning on even ground; maintain a level platform by controlling the stabilizers if they begin to shift or settle; detect when a stationary machine is deviating from a level position (e.g., when the crane begins to tip); warn an operator about an impending tipping; and/or control one or more motors or valves to limit dynamic movements of the crane to prevent tipping or other unsafe movement.

In another example use embodiment of a system according to the present disclosure, a control unit 42 having a sensor unit 40 is installed on a rotating upper structure of a machine (e.g., an excavator). The control unit 42 uses orientation data from the sensor unit 40 to, e.g., perform one or more of: sense one or both of the angle and angular velocity of the rotating upper structure; and/or control the motor or motors driving the upper structure to provide position, velocity, and acceleration based control.

In another example use embodiment of a system according to the present disclosure, control units 42, each having a sensor unit 40, are installed on the actuator of each of a boom, bucket, arm, and swing of an excavator and the control units 42, using the data from the sensor unit 40 and machine geometry data, provide for one or more of: automated or semi-automated functions such as causing the overall system or a component thereof to return from a current position to a predetermined position; to set operational boundaries or constraints in 3 dimensional space for the overall system or a component thereof, e.g., to avoid damaging or contacting buried or overhead hazards; and/or set operation boundaries or constraints to prevent an undesirable re-orientation of the chassis, e.g., to set an operating bound on the bucket to prevent the chassis from tipping if the chassis is positioned on a slope. In some examples, the system also includes pressure sensors that detect hydraulic pressure at various points in the hydraulic system and the pressure data can be used to estimate loads and thereby further constrain operation based on dynamically calculated centers of gravity of the those loads. Shifts in centers of gravity, such as when material in a bucket is added, removed or shifted, can also be detected and accounted for.

In another example use embodiment of a system according to the present disclosure, a control unit 42 having a sensor unit 40 is installed on each of one or more attachments (e.g., buckets, forks) of a loader, and the control unit 42 uses orientation data from the sensor units 40 to, e.g., perform one or more of: maximize bucket or fork capacity by achieving maximum allowable bucket leveling relative to the ground; maximize stability by leveling relative to the equipment's wheels; and/or provide information to an operator or another control unit to enable higher vehicle stability, e.g., by limiting ground speed and steering rate when the boom is raised.

Figure 4:
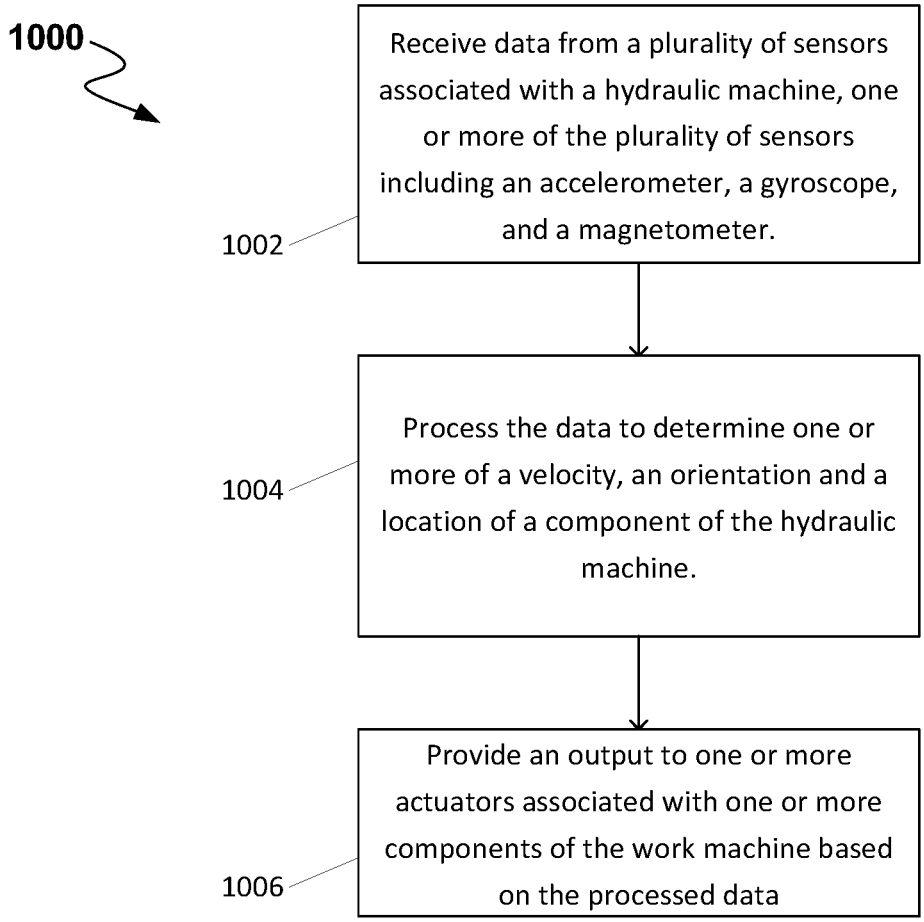
FIG. 4 is a schematic flow chart showing a process that can be implemented by the control system shown at FIG. 3.

Referring to FIG. 4, a schematic is presented showing the generalized operation 1000 of the control system. In a step 1002, the system receives data from a plurality of sensors associated with a hydraulic machine. In some examples, one or more of the plurality of sensors include an accelerometer, a gyroscope, and a magnetometer. In a step 1004, the data is processed to determine one or more of a velocity, an orientation and a location of a component of the hydraulic machine. Example components of the hydraulic machine can include, as related above, the chassis, boom, arm, and end effector (e.g. bucket). In a step 1006, the control system provides an output to one or more actuators associated with one or more components of the work machine based on the processed data, such as any of the output actions described above.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A hydraulic system, comprising:

a plurality of movable loads; and a plurality of control units, each of the plurality of control units being associated with a different one of the plurality of movable loads, each of the plurality of control units including an accelerometer, a gyroscope, and a magnetometer, wherein for each of the plurality of control units, the accelerometer is adapted to detect an orientation of the control unit relative to a gravity force vector, the magnetometer is adapted to detect an orientation of the control unit relative to a fixed magnetic field, and the gyroscope is adapted to detect yaw, pitch and roll rates of the control unit; and wherein each of the control units is installed on a hydraulic actuator associated with a corresponding one of the plurality of movable loads; and wherein the hydraulic system includes a chassis adapted to be positioned on the ground, the chassis having associated therewith one of the plurality of control units.

2. The hydraulic system of claim 1, wherein each of the plurality of control units is adapted to process data collected by the accelerometer and the magnetometer when the hydraulic system is in a non-operational mode, and wherein each of the plurality of control units is adapted to process data collected by the gyroscope when the hydraulic system is in an operational mode.

3. The hydraulic system of claim 2, wherein to process the data collected from the accelerometer and the magnetometer includes determining orientation and heading of one of the plurality of control units to provide initial positions of one or more components of the hydraulic system.

4. The hydraulic system of claim 3, wherein the data collected by the gyroscope is combined with the initial positions to determine current positions of the one or more components of the hydraulic system.

5. The hydraulic system of claim 1, wherein the plurality of control units are configured to generate a kinematic model of the hydraulic system.

6. The hydraulic system of claim 1, wherein each of the plurality of control units does not process data collected by the gyroscope when the hydraulic system is in a non-operational mode.

7. The hydraulic system of claim 1, wherein each of the plurality of control units does not process data collected by the accelerometer or by the magnetometer when the hydraulic system is in an operational mode.

8. The hydraulic system of claim 1, wherein the hydraulic system comprises one of: a crane, an excavator, and a loader.

9. The hydraulic system of claim 1, wherein a first of the plurality of control units is installed on a hydraulic actuator associated with a boom, a second of the plurality of control units is installed on a hydraulic actuator associated with an arm, and a third of the plurality of control units is installed on a hydraulic actuator associated with a bucket, wherein the first, the second and the third of the plurality of control units are adapted, respectively, to determine, using data collected from the accelerometer, magnetometer, and gyroscope, positions of the boom, the arm, and the bucket.

10. The hydraulic system of claim 1, wherein each of the one or more control units is adapted to use data collected from one or more of the accelerometer, the gyroscope, and the magnetometer to perform one or more of:

control placement of one or more stabilizers;

achieve level positioning of at least one component of the hydraulic system relative to the ground;

detect a deviation from a level condition;

provide an alert to an operator;

control position, velocity, and/or acceleration of a rotating or non-rotating structure;

return a component from a current position to a preset position;

constrain movement of a component in space;

prevent tipping of the chassis;

maximize a bucket capacity; and maximize stability of the hydraulic system.

11. A method of operating a work machine, the method comprising:

receiving data from a plurality of control units associated with a hydraulic machine, wherein each of the plurality of control units includes an accelerometer, a magnetometer, and a gyroscope;

processing the data to determine one or more of a velocity, an orientation, and a location of a component of the hydraulic machine; and providing an output to at least one of a plurality of hydraulic actuators associated with one or more components of the work machine based on the processed data, wherein each of the plurality of control units is installed on a different one of the plurality of hydraulic actuators and each of the plurality of hydraulic actuators is associated with a different one of a plurality of loads of the work machine; and wherein the plurality of control units includes a control unit associated with a platform rotatable with respect to a chassis of the work machine.

12. The method of operating a work machine of claim 11, further comprising:

determining an orientation of each of the plurality of sensors with respect to each other and the work machine with data received from the magnetometers of the plurality of control units.

13. The method of operating a work machine of claim 11, wherein the step of processing the data includes utilizing a rotation matrix.

14. The method of operating a work machine of claim 11, wherein the plurality of control units includes a control unit associated with a boom of the work machine, a control unit associated with an arm of the work machine, and a control unit associated with an end effector of the work machine.

15. The method of operating a work machine of claim 14, wherein the step of processing the data includes calculating a position of the end effector.

16. The method of operating a work machine of claim 14, wherein the plurality of hydraulic actuators includes a hydraulic actuator associated with the platform to rotate the platform with respect to the chassis; a hydraulic actuator associated with the boom to move the boom relative to the platform; a hydraulic actuator associated with the arm to move the arm relative to the boom; and a hydraulic actuator associated with the end effector to move the end effector relative to the arm.

17. A hydraulic system, comprising:

a plurality of movable loads; and a plurality of control units, each of the plurality of control units being associated with a different one of the plurality of movable loads, each of the plurality of control units including an accelerometer, a gyroscope, and a magnetometer, wherein for each of the plurality of control units, the accelerometer is adapted to detect an orientation of the control unit relative to a gravity force vector, the magnetometer is adapted to detect an orientation of the control unit relative to a fixed magnetic field, and the gyroscope is adapted to detect yaw, pitch and roll rates of the control unit;

wherein a first of the plurality of control units is installed on a hydraulic actuator associated with a boom;

wherein a second of the plurality of control units is installed on a hydraulic actuator associated with an arm;

wherein a third of the plurality of control units is installed on a hydraulic actuator associated with a bucket; and wherein the first, second and third of the plurality of control units are adapted, respectively, to determine, using data collected from the accelerometer, the magnetometer, and the gyroscope, positions of the boom, the arm, and the bucket.

* * * * *